US006684832B1

(12) United States Patent
Codina et al.

(10) Patent No.: US 6,684,832 B1
(45) Date of Patent: Feb. 3, 2004

(54) OSCILLATING CAMSHAFT CONTROLLED VALVE OPERATING DEVICE

(76) Inventors: Roberto Marcelo Codina, Guale Guaychú 2666 1°A, Buenos Aires Buenos Aires (AR), 1417; Sergio Daniel Codina, 3550 Green CT, Ann Arbor, MI (US) 48105

( * ) Notice: Subject to any disclaimer, the term of this patent is extended or adjusted under 35 U.S.C. 154(b) by 0 days.

(21) Appl. No.: 10/249,635

(22) Filed: Apr. 28, 2003

(51) Int. Cl.[7] ..... F01L 1/34

(52) U.S. Cl. ..... 123/90.16; 123/90.17; 123/90.44; 123/90.45

(58) Field of Search ..... 123/90.16, 90.17, 123/90.44, 90.45

(56) References Cited

U.S. PATENT DOCUMENTS 5,937,809 A * 8/1999 Pierik et al. ..... 123/90.16
6,019,076 A * 2/2000 Pierik et al. ..... 123/90.16
6,378,474 B1 * 4/2002 Pierik ..... 123/90.16
6,382,152 B2 * 5/2002 Pierik ..... 123/90.16
6,425,357 B2 * 7/2002 Shimizu et al. ..... 123/90.16
6,550,437 B2 * 4/2003 Nakamura et al. ..... 123/90.16

* cited by examiner

*Primary Examiner*—Thomas Denion
*Assistant Examiner*—Zelalem Eshete

(57) ABSTRACT

A valve operating device of an internal combustion engine, capable of varying the lift, the opening and closing angle of the intake valves. What makes it unique is that the camshaft is not fixed to the cylinder head, but it oscillates around a shaft, and by means of this oscillation, the valve lift and duration are changed. A command shaft changes the angular position of the camshaft holders and thus the camshaft position. The camshaft is driven by the crankshaft and rotates inside the camshaft holder. The cams drive intermediate arms. Rocker arms are driven by the intermediate arms and, in turn, drive the valves.

11 Claims, 22 Drawing Sheets

OSCILLATING CAMSHAFT CONTROLLED VALVE OPERATING DEVICE

BACKGROUND OF INVENTION

This invention relates to an internal combustion engine and more particularly to a variable valve admission operating device for such engines.

In search of improving the performance of an engine, many systems that change the valve opening characteristics have been invented. Of such systems, those that allow a change in the amount of air entering the cylinder by gradually and simultaneously varying lift and duration, have demonstrated to achieve a sensible drop in emissions and energetic pumping losses, a faster throttle response and an increase in torque.

A series of disadvantages is present in almost all of those systems invented, as poor reliability, great complexity, high number of parts, high costs and difficulty of production, high energetic losses due to high reciprocating mass, high inertia, wear, noise.

Systems that allow a change in amount of air entering the cylinder by gradually and simultaneously varying lift and duration of the valve are known in the art. A device (according to Japanese Application Patent 2000-078134 U.S. Equivalent U.S. Pat. No. 6,425,357) that tries to address the problem of a link mechanism likely to be long and complicated, has also got its disadvantages. Some of the intermediate drive system parts are of very difficult construction, which renders the mechanism anything but economic to construct. Furthermore, the stopper pin (132*a*) is subject to very important loads compared to its size and, thus, its durability is questionable. Another characteristic is that the intermediate drive mechanism is composed from many big parts that have reciprocating motion, resulting in unacceptable reciprocating mass.

Another device (according to European Patent Office patent EP1143118) with an acceptable cost of construction, simplicity and reliability was effectively built and massively produced, obtaining significant advances in fuel consumption, emissions and torque. However, its limitation is still the high reciprocating mass of the arms (ref. 7) that drive the rocker arms, that causes undesirable energetic losses. Furthermore, its parts are complex and of difficult construction, requiring astonishing tolerances. These energetic losses increase rapidly as the engine speed increases which limitates the use of systems of this kind in low-displacement high-speed engines. Furthermore, a raise in engine speed generate bigger efforts, and thus bigger parts (increasing the reciprocating mass problem), or the need of much more expensive materials.

The principal objective behind this invention is, precisely, to obtain a design in which the reciprocating masses are greatly reduced, which would lead to a decrease in the energetic losses due to the movement of the reciprocating mass. It is also of the greatest importance the simplicity, reliability, strength and its simple and economical construction. The best way of reducing to the minimum the reciprocating mass is not to include in the reciprocating-moving parts the sub assemblies used to change the lift characteristics. In the second device (EP1143118), this happens, but those masses are still very high, due to the use of long arms. Searching for alternatives, the best one found was an oscillating camshaft as the way to change the valve lift.

The great breakthrough and what makes this system unique is the fact that the camshaft does not rotate on a fixed support in the cylinder head, but on a support which rotates around a main shaft. This means that the camshaft not only rotates but it translates up and down. By making this translation movement the valve lift and duration are increased or decreased.

It is, therefore, a principal object to this invention to provide an improved valve operating device for an internal combustion engine wherein a reduction in the complexity and the alternative masses is possible.

It is a further object to this invention to provide an economical, efficient, reliable and stepless variable valve lift and duration control mechanism for the valves of an internal combustion engine. It is a yet further object to this invention to provide an improved valve operating device for an internal combustion engine wherein an increase in performance (allows higher engine speeds than other similar systems and, thus, increases the power output) and a slight increase in fuel economy without increasing the production costs, or even lowering them, is possible.

SUMMARY OF INVENTION

This invention is a variable valve operating device for the valves of an internal combustion engine, capable of varying the lift, the opening and closing angles of the intake valves. And with an entirely new approach: the change in valve lift is achieved by means of translating the camshaft axis position. The result is an improvement in simplicity, production costs, reduction of reciprocating mass and reliability, compared to similar systems.

The variable valve operating device is composed by a camshaft that operates connected to the crankshaft through a pair of gears and a phase-difference varying device, a main shaft fixed on the cylinder head, one camshaft holder per cylinder that rotates around the main shaft. Also, a command shaft mounted on the cylinder head, which, by its moving, changes the angular position of all camshaft holders simultaneously, is provided. As a result, the camshaft axis rotates around the main shaft with an oscillating translation, driven by the command shaft. An intermediate arm per admission valve rotates around the main shaft and remains in contact with the cams of the camshaft by means of a spiral spring per cylinder. Each intermediate arm drives a rocker arm, which in turn drives the valve, keeping both in contact by means of a valve spring. Changing the position of the throttle pedal, a control system rotates the command shaft, which changes the camshaft position. This change displaces the extreme positions of the movement of the intermediate arms, thus changing the lift and the duration of the valve movement.

DETAILED DESCRIPTION

Figure 1:
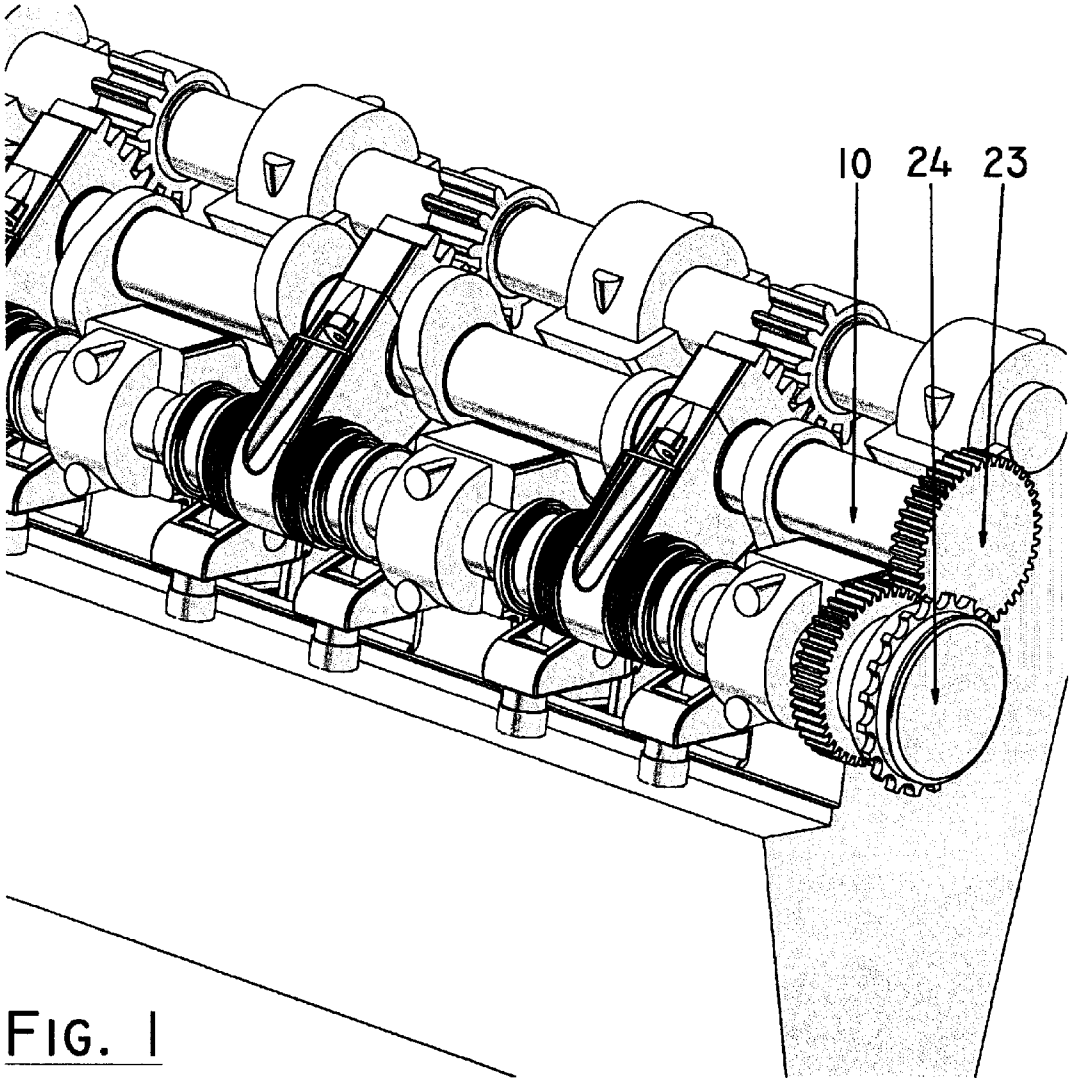
FIG. 1 is a perspective view showing the cylinder head with all the components of the system.

Referring now to the drawings, starting with FIG. 1 a portion corresponding to the cylinder head of an overhead valve type internal combustion engine, is illustrated. The crankshaft drives a phase-difference varying device (ref. 24) of any known type connected by a chain or drive belt (not shown). This phase-difference device has its rotation axis coincident with the main shaft (ref. 1, shown in FIG. 2) and includes a gear that connects to another gear (ref. 23) connected to an extreme of the camshaft (ref.10). In this way, when the camshaft rotates around the main shaft the contact between both gears is maintained. The main shaft is fixed to the cylinder head by means of a series of caps (ref. 16, shown in FIG. 2).

Figure 2:
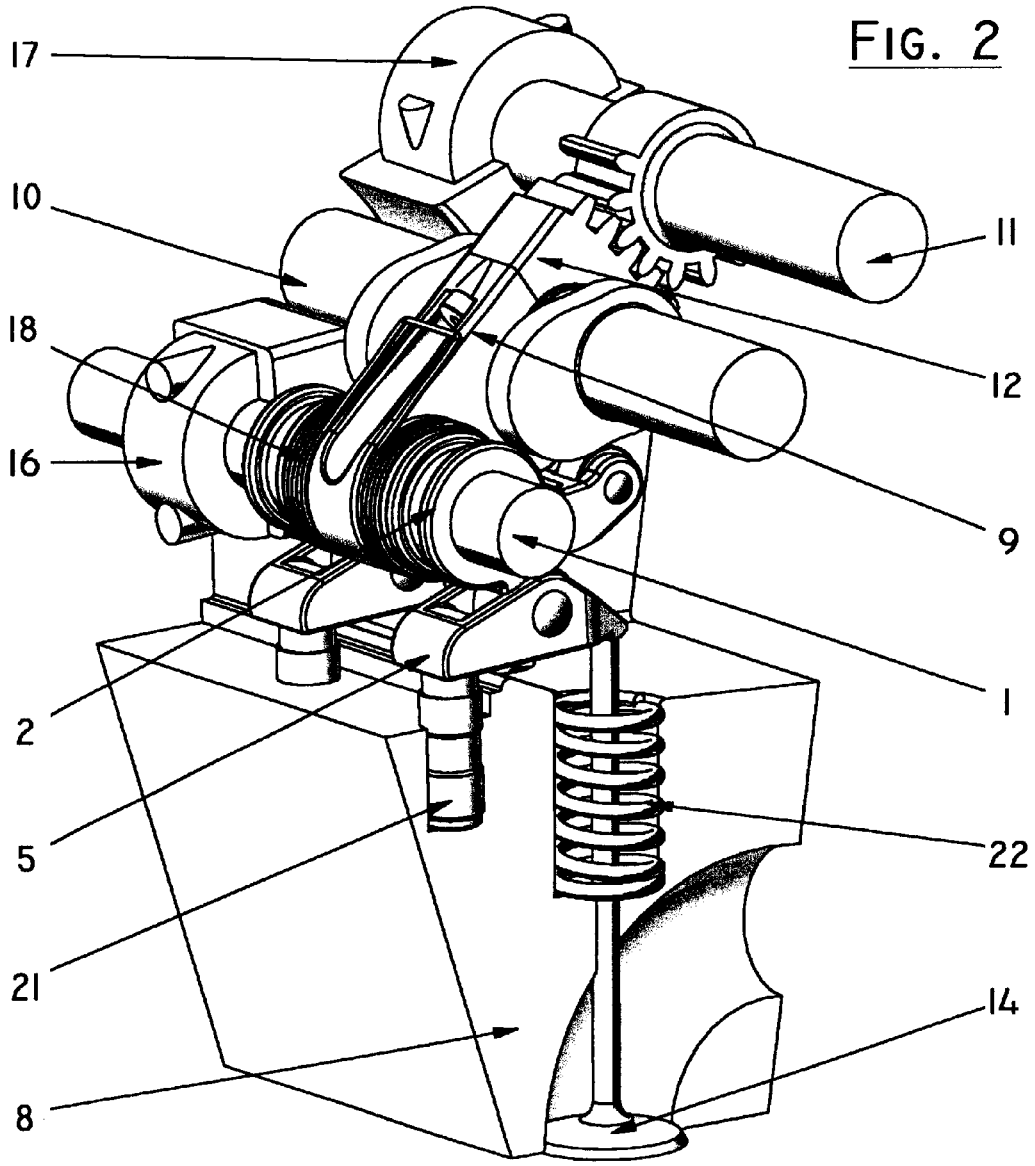
FIG. 2 is a perspective view showing the portion of the cylinder head with all the components of the system, corresponding to a single cylinder.

A portion of the cylinder head with all the components of the system, corresponding to a single cylinder is illustrated in FIG. 2. Since the invention deals primarily with the valve operating mechanism, only the cylinder head portion (ref. 8) corresponding to the intake valves of the engine is depicted. For each cylinder the camshaft has a pair of cams, one for each valve. As the camshaft (ref. 10) rotates, each cam provides driving force to a roller (ref. 4, shown in FIG. 6), which is allowed to rotate around its roller pin (ref. 3, shown in FIG. 6). The roller pin, in turn, drives an intermediate arm (ref. 2). The intermediate arm rotates around the main shaft and is forced against the cam by a spiral spring (ref. 18). Thus, the camshaft rotation causes in the intermediate arms a reciprocating motion, oscillating between a minimum and a maximum position. The intermediate arm has a working surface (ref. 28, shown in FIG. 7) that maintains contact with the roller (ref. 7, shown in FIG. 6) of the rocker arm (ref. 5). As the intermediate arm rotates it provides driving force to the roller, which in turn drives the pin (ref. 6, shown in FIG. 6), which drives the rocker arm. The rocker arm rotates around the hydraulic adjuster (ref. 21) pushing the valve (ref. 14) to its open position. The contact between the roller and the intermediate arm and between the valve and the rocker arm is maintained by the valve spring (ref. 22).

Figure 3:
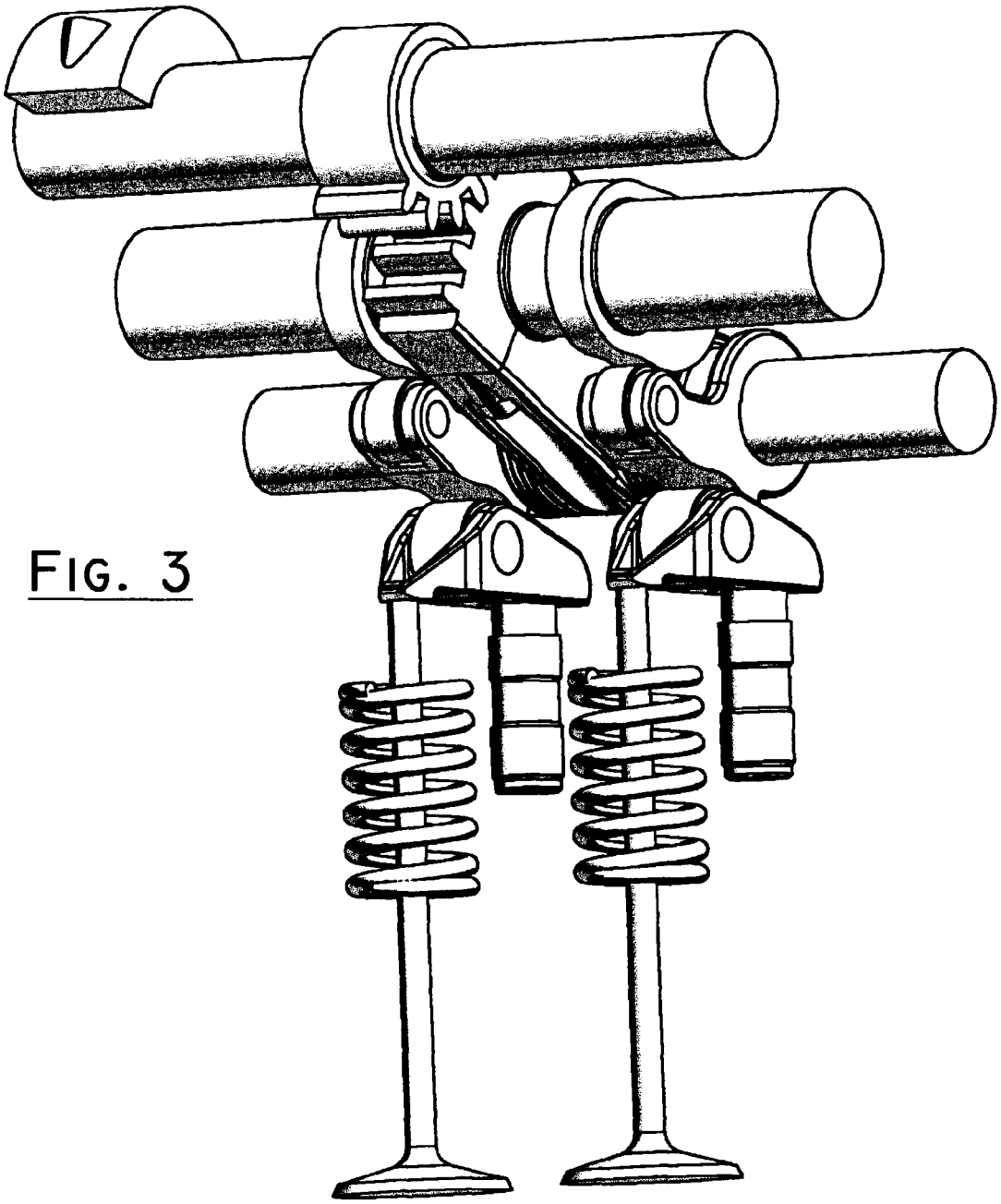
FIG. 3 is a perspective view from a different angle, showing all the components of the system, corresponding to a single cylinder.

In FIG. 3, the same array, without the cylinder head, can be appreciated from a different angle, allowing a better understanding.

Figure 4:
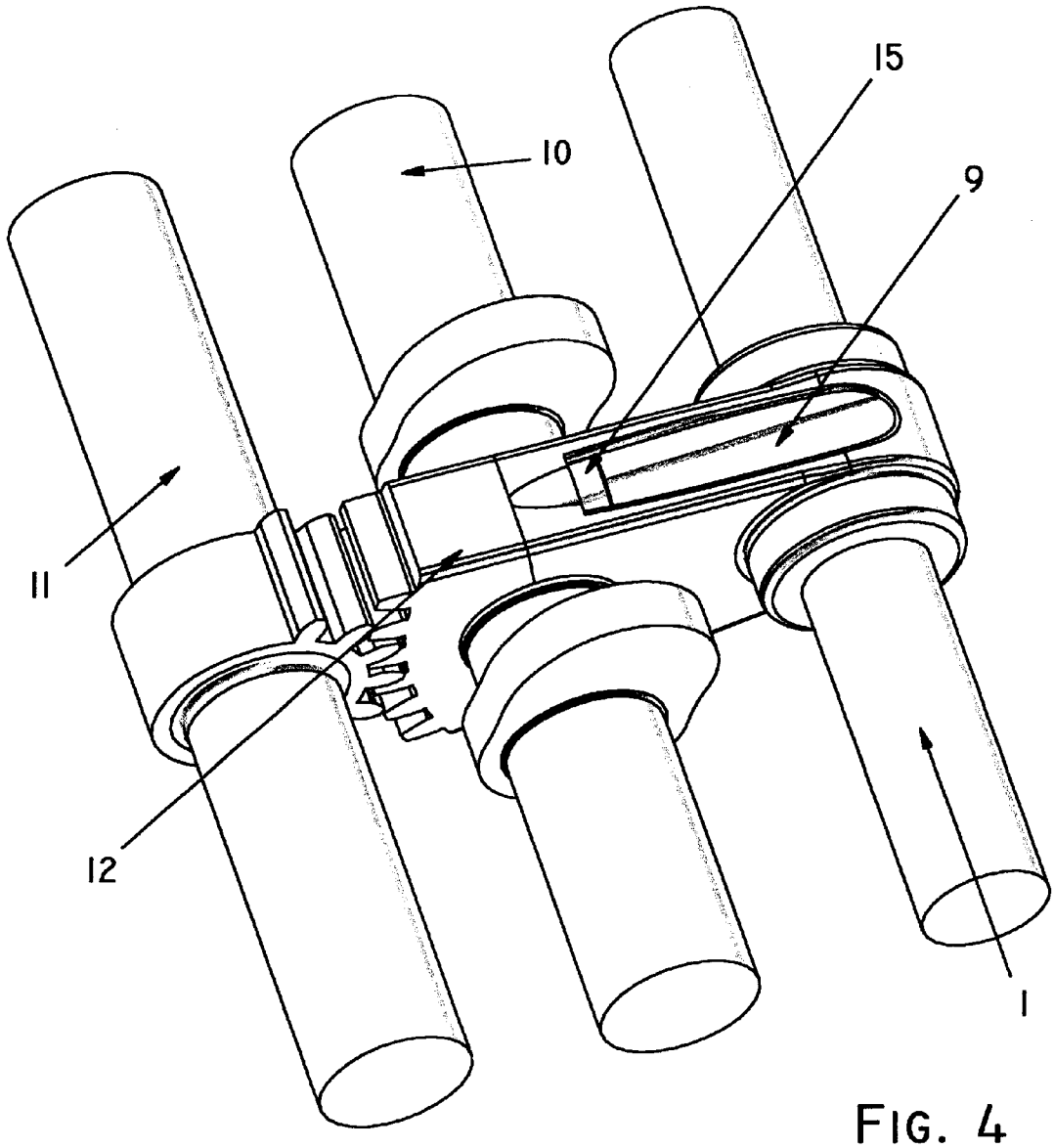
FIG. 4 is a perspective view showing in more detail the command shaft, the camshaft and the camshaft holder corresponding to a single cylinder.
Figure 5:
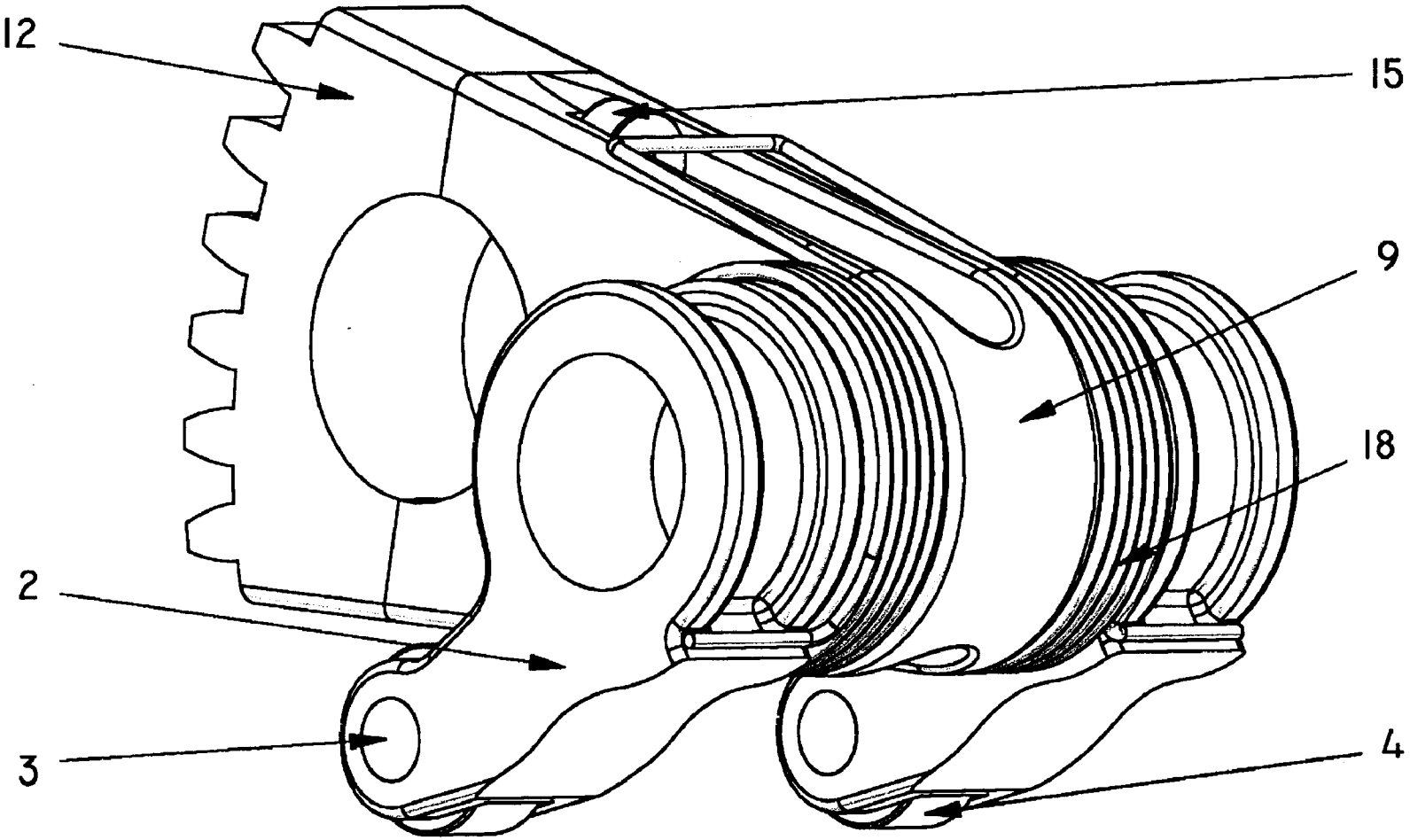
FIG. 5 is a perspective view showing in more detail the command shaft, the camshaft and the camshaft holder corresponding to a single cylinder.

Referring now to FIG. 4 and FIG. 5, the mechanism that changes the camshaft position will be described in detail. The camshaft holder (ref. 9) rotates around the main shaft (ref. 1), that is fixed to the cylinder head by a series of caps (ref. 16, shown in FIG. 2). The camshaft (ref. 10) rotates freely inside its placement and it is held in place by the toothed cap (ref. 12) and this assembly is held in place by a pair of shoulder bolts (ref. 15). The command shaft (ref. 11) rotates in a limited way inside its placement in the cylinder head (ref. 8, shown in FIG. 2) and held in place by a series of caps (ref. 17, shown in FIG. 2). The command shaft has a toothed wheel aligned with the center of each cylinder and aligned with each one of the corresponding camshaft holders. As it is seen in FIG. 1, the rotation of the command shaft drives all the camshaft holder assemblies simultaneously, changing the camshaft position in a way that the distance between the camshaft axis and the main shaft axis remains the same. It is convenient to mention that the transmission of movement between the command shaft and the camshaft holder can be achieved, not only with pairs of toothed wheels, but also by several other mechanisms.

Figure 7:
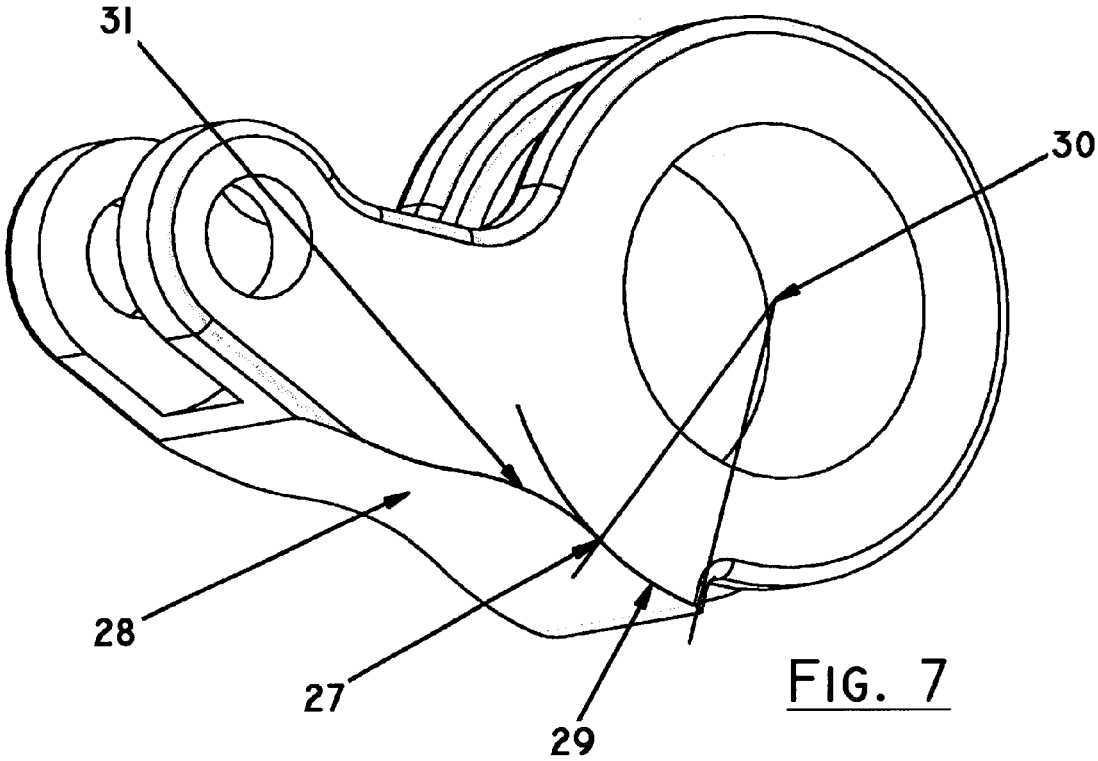
FIG. 7 is a perspective view showing the intermediate arm and its working profile.

The intermediate arm (ref. 2), that can be better appreciated in FIG. 7, has a working surface (ref. 28) whose profile has two portions. The first portion is generated by a segment of circle (ref. 29) whose center is coincident with the center (ref. 30) of the bore through which the main shaft is mounted. Since the intermediate arm rotates around the main shaft and the first portion of the profile is concentric with the axis of the main shaft, if the contact point between the intermediate arm and the roller of the rocker arm (ref. 7) remains within this portion, the rocker arm will remain at the rest position. The second portion (ref. 31) starts at the end of the previous portion (ref. 27) and is a curve that withdraws from the center of the bore (ref. 30). As a result, if the contact point between the intermediate arm and the roller of the rocker arm moves within the second portion, the roller of the rocker arm will withdraw gradually from the center of the main shaft, as the roller of the intermediate arm withdraws from the axis of the camshaft.

Figure 13:
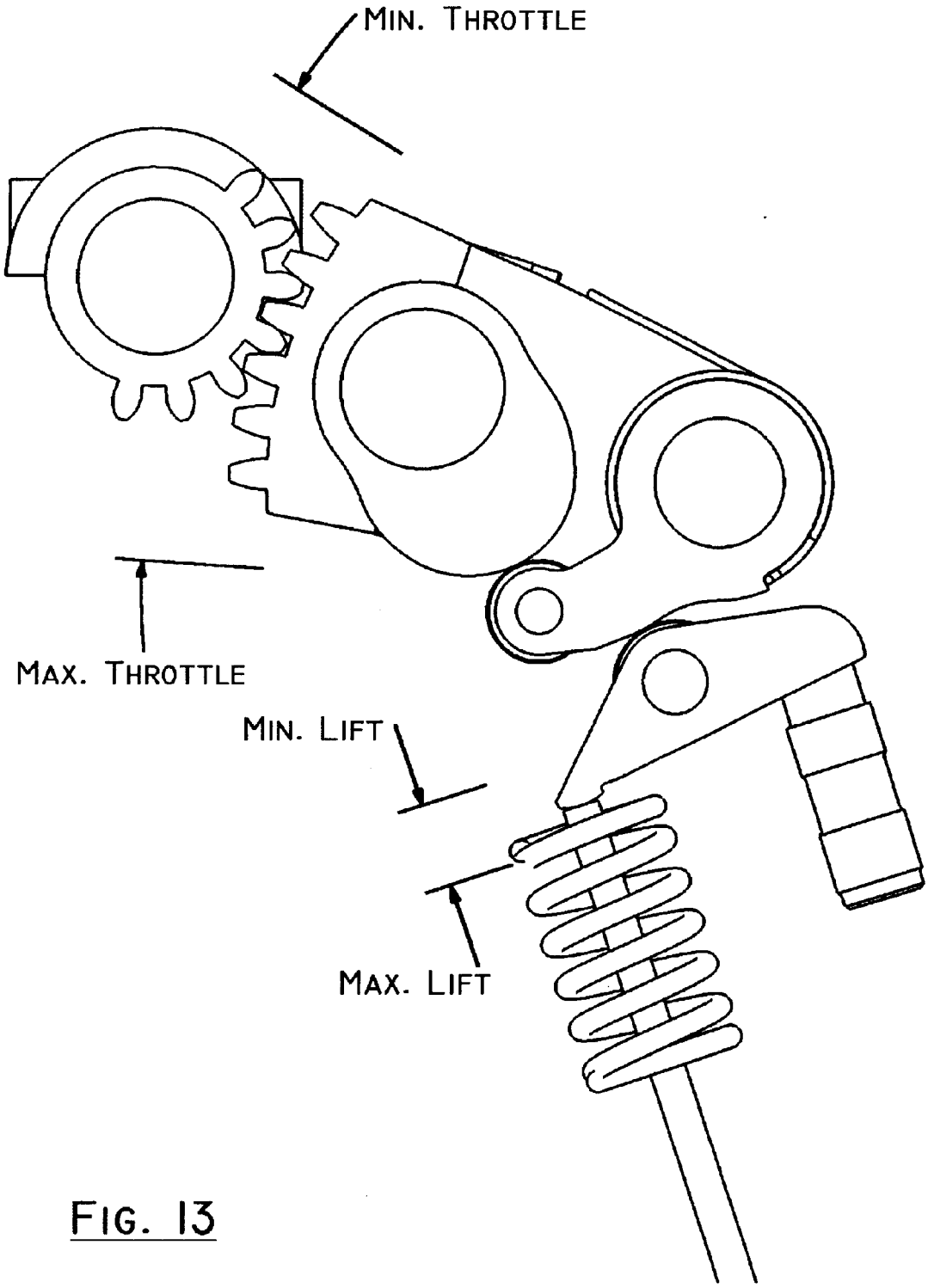
FIG. 13 is a plan view showing the position of the components of the system with the command shaft and the camshaft holder in an intermediate position. The camshaft is in open position.
Figure 14:
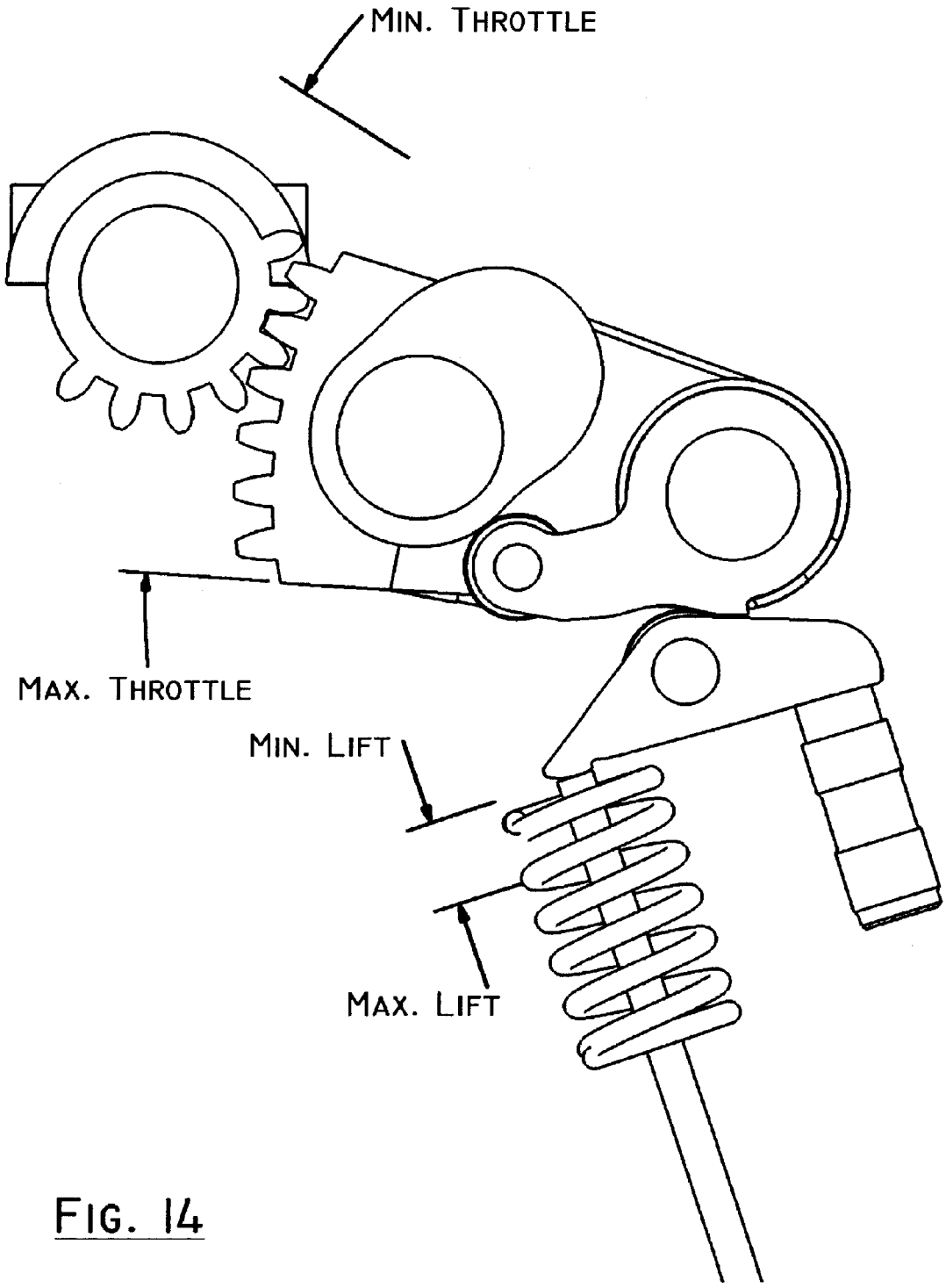
FIG. 14 is a plan view showing the position of the components of the system with the command shaft and the camshaft holder in max throttle position. The camshaft is in closed position.
Figure 15:
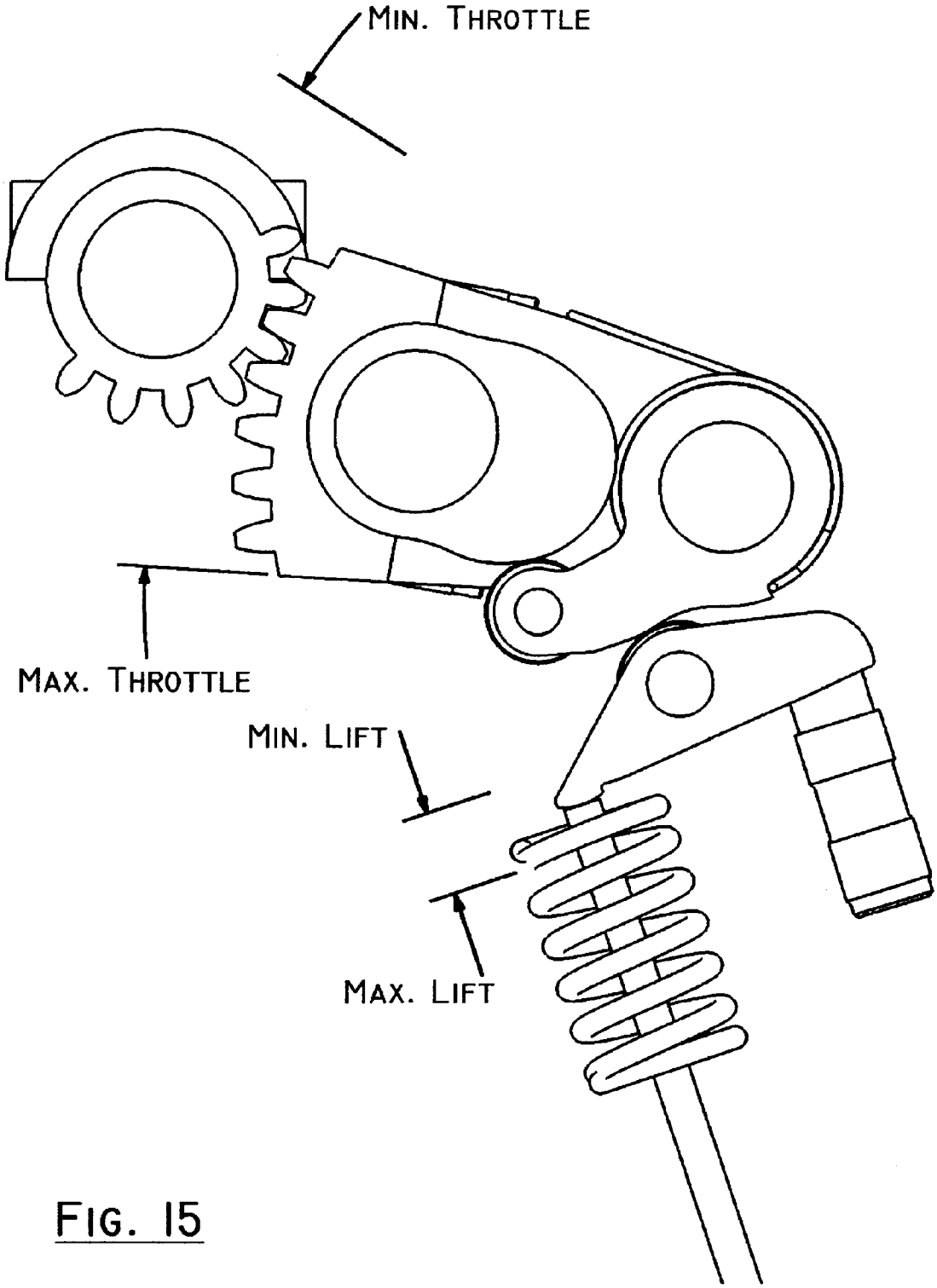
FIG. 15 is a plan view showing the position of the components of the system with the command shaft and the camshaft holder in max throttle position. The camshaft is in an intermediate position.

In the sequence of FIGS. 13, 14 and 15 is shown how the rocker arm moves driven by the intermediate arm, which changes position as the camshaft rotates, driving the rocker arm that rotates around the hydraulic adjuster (ref. 21) that is axially fixed to the cylinder head allowing a very small longitudinal movement, compensating the lash between the rocker arm, the valve and the intermediate arm in a well known manner. As the rocker arm lowers, the valve opens.

Figure 6:
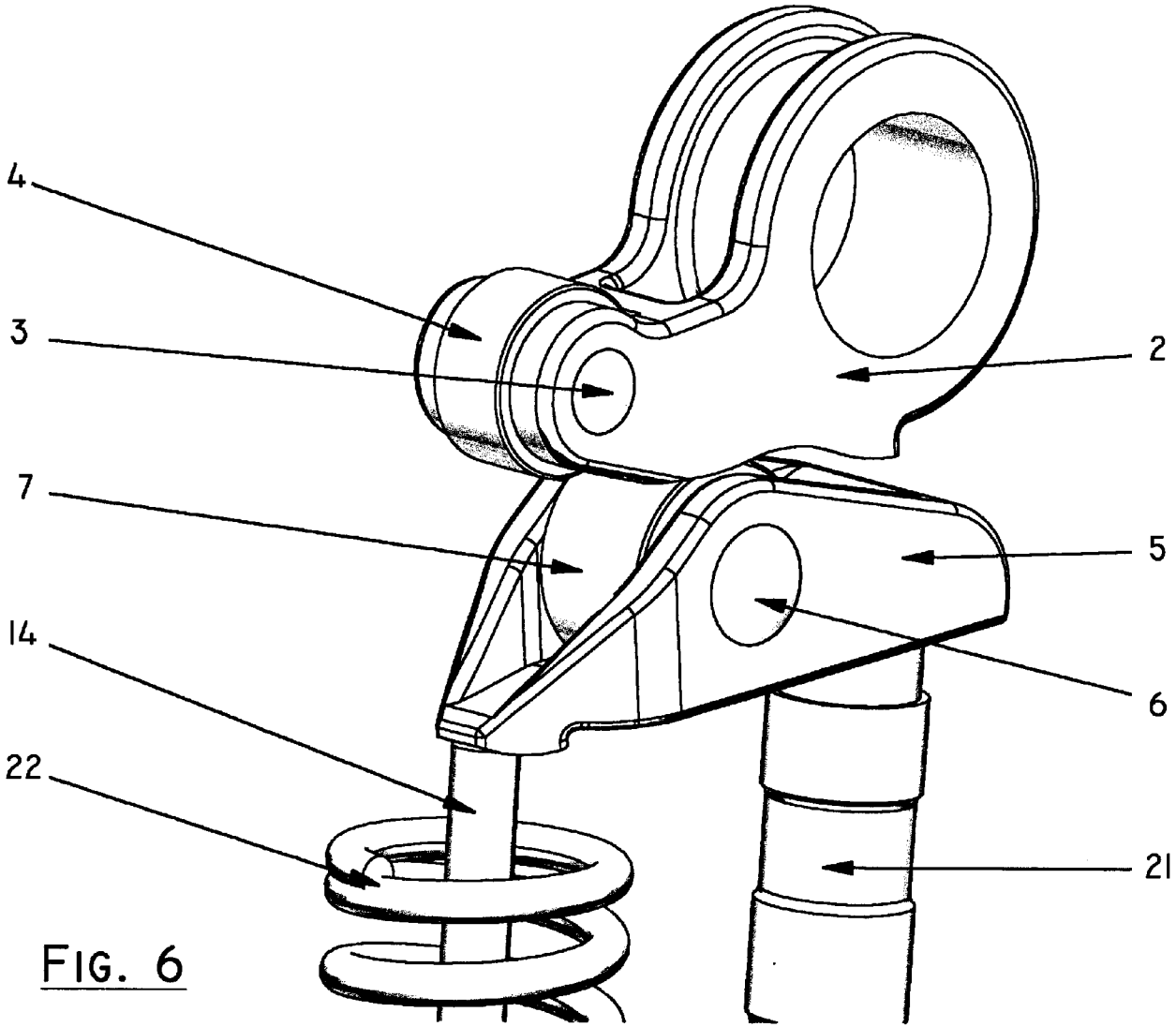
FIG. 6 is a perspective view showing in more detail the rocker arm and its components, the intermediate arm and its components and the hydraulic adjuster corresponding to a single valve.
Figure 8:
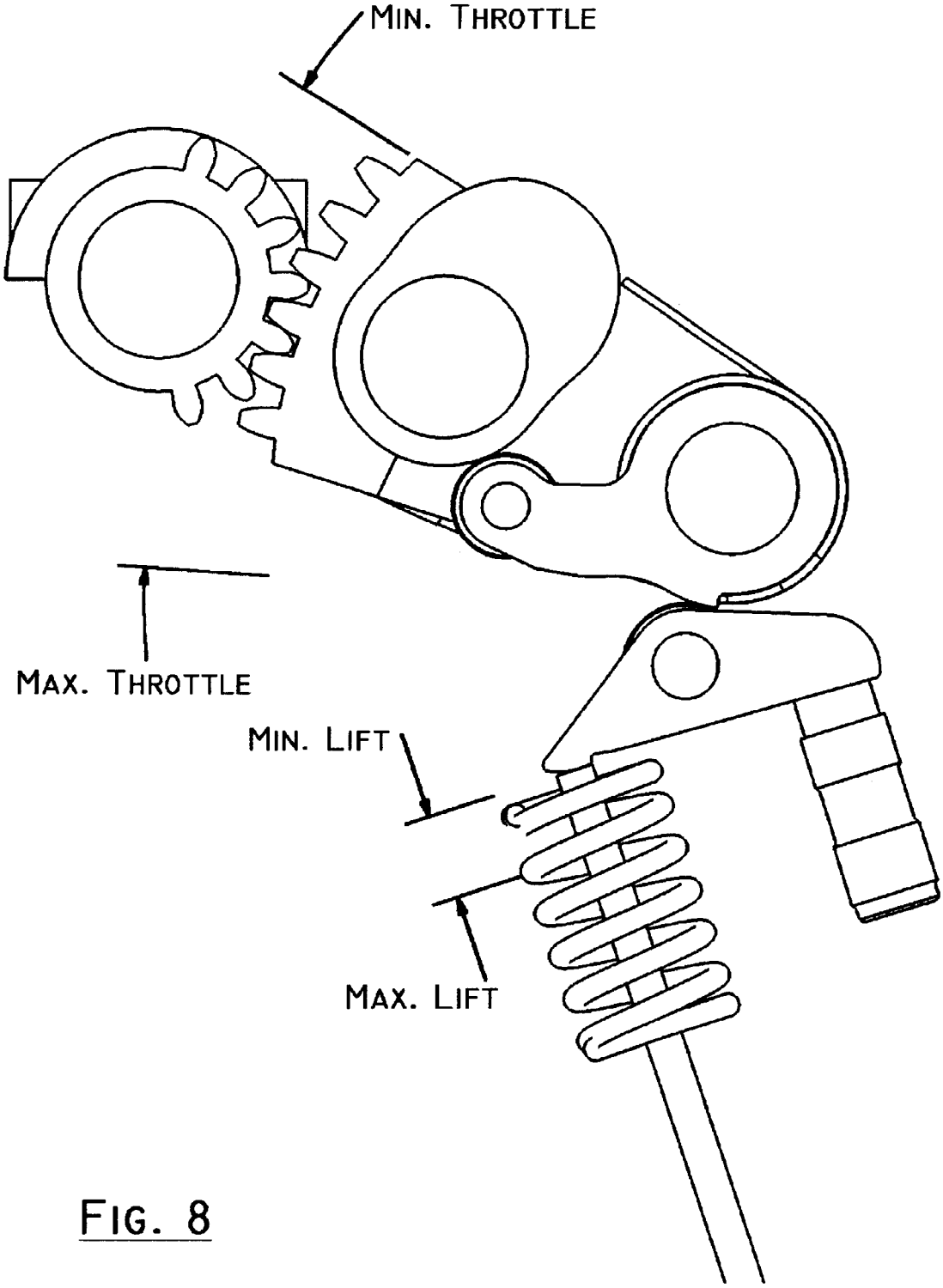
FIG. 8 is a plan view showing the position of the components of the system with the command shaft and the camshaft holder in idle position. The camshaft is in closed position.
Figure 9:
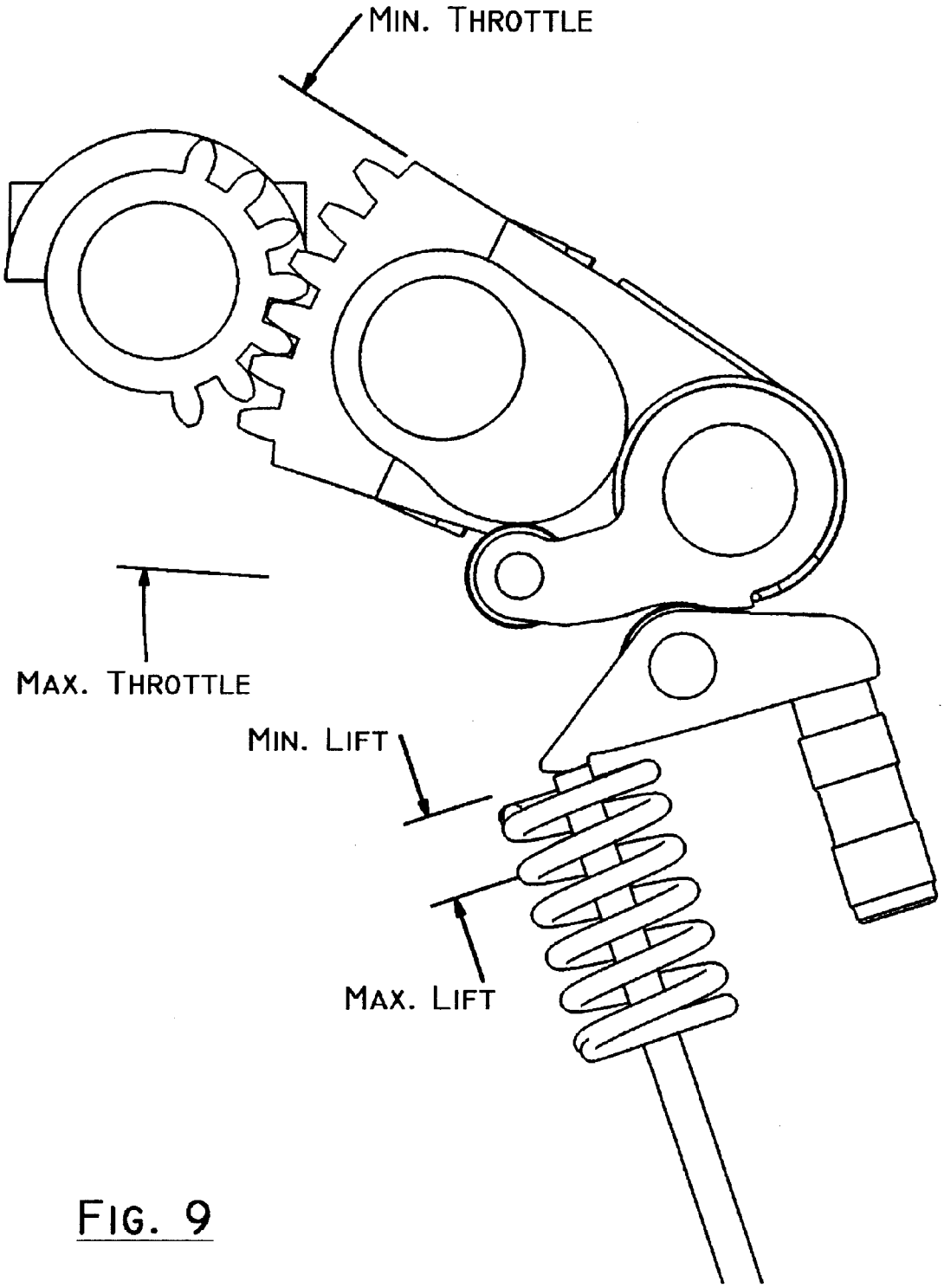
FIG. 9 is a plan view showing the position of the components of the system with the command shaft and the camshaft holder in idle position. The camshaft is in an intermediate position.
Figure 10:
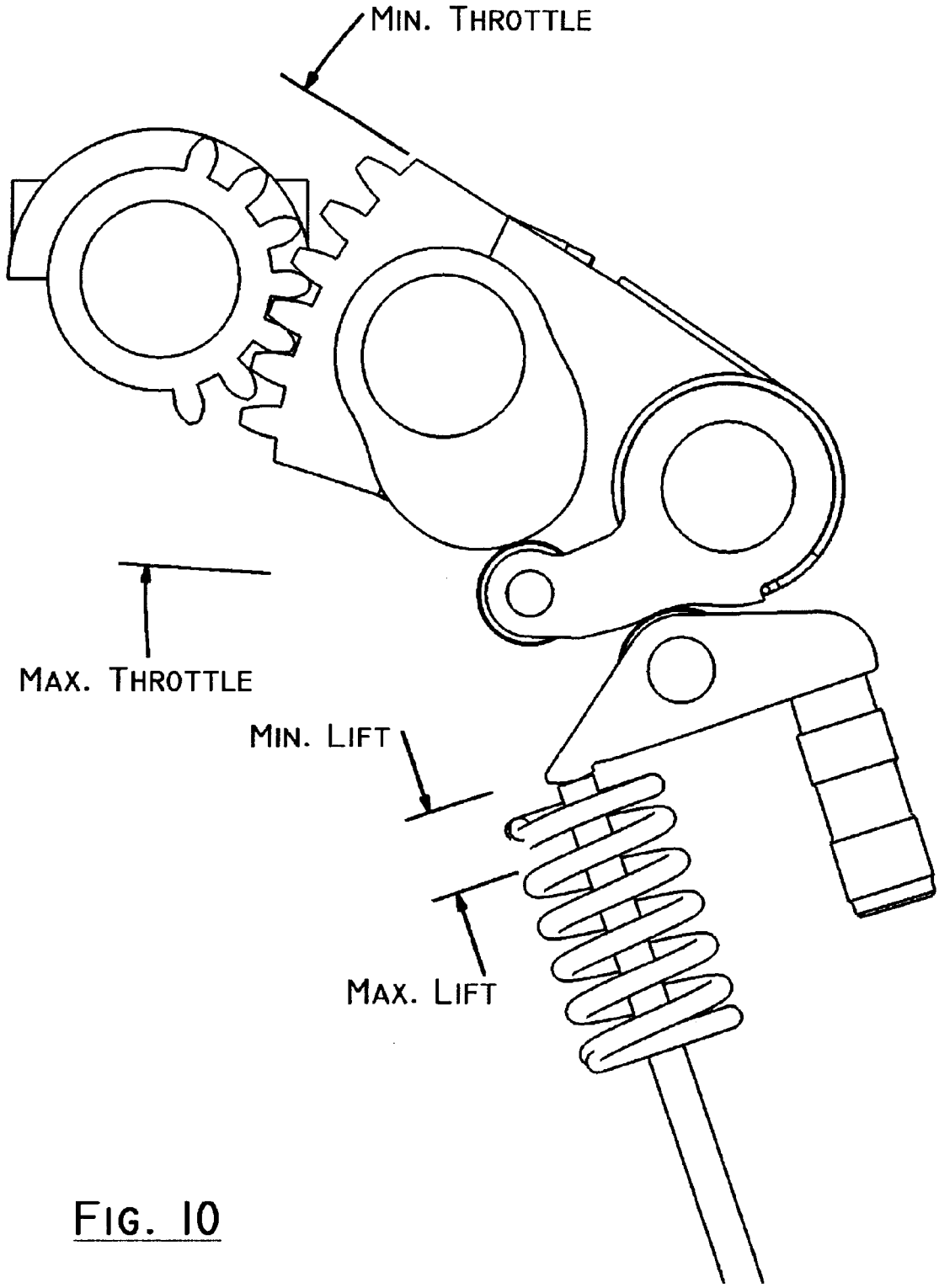
FIG. 10 is a plan view showing the position of the components of the system with the command shaft and the camshaft holder in idle position. The camshaft is in open position.

In FIGS. 8 and 9, the camshaft is at the farthest point in relation to the rocker arm roller (ref. 7, shown in FIG. 6). This is the idle position (Min. Throttle). At this position we can appreciate in both FIGS. 8 and 9 that since the contact point between the intermediate arm (ref. 2, shown in FIG. 2) and the roller of the rocker arm remains within the first portion of the working surface (ref. 28, shown in FIG. 7) the roller and, thus, the rocker arm, don't move. In FIG. 10 the camshaft holder remains at the idle position but the contact between the intermediate arm and roller has reached the second portion of the working surface. The roller has moved and, thus, the rocker arm also moved and the valve has just opened. Since at this point the cam is at its maximum displacement position, as it continues to rotate, the valve will start to close. As we can see, with the camshaft holder (ref. 9, shown in FIG. 2) at idle position the lift of the valve will be minimum and so will be the time the valve will remain open.

Figure 11:
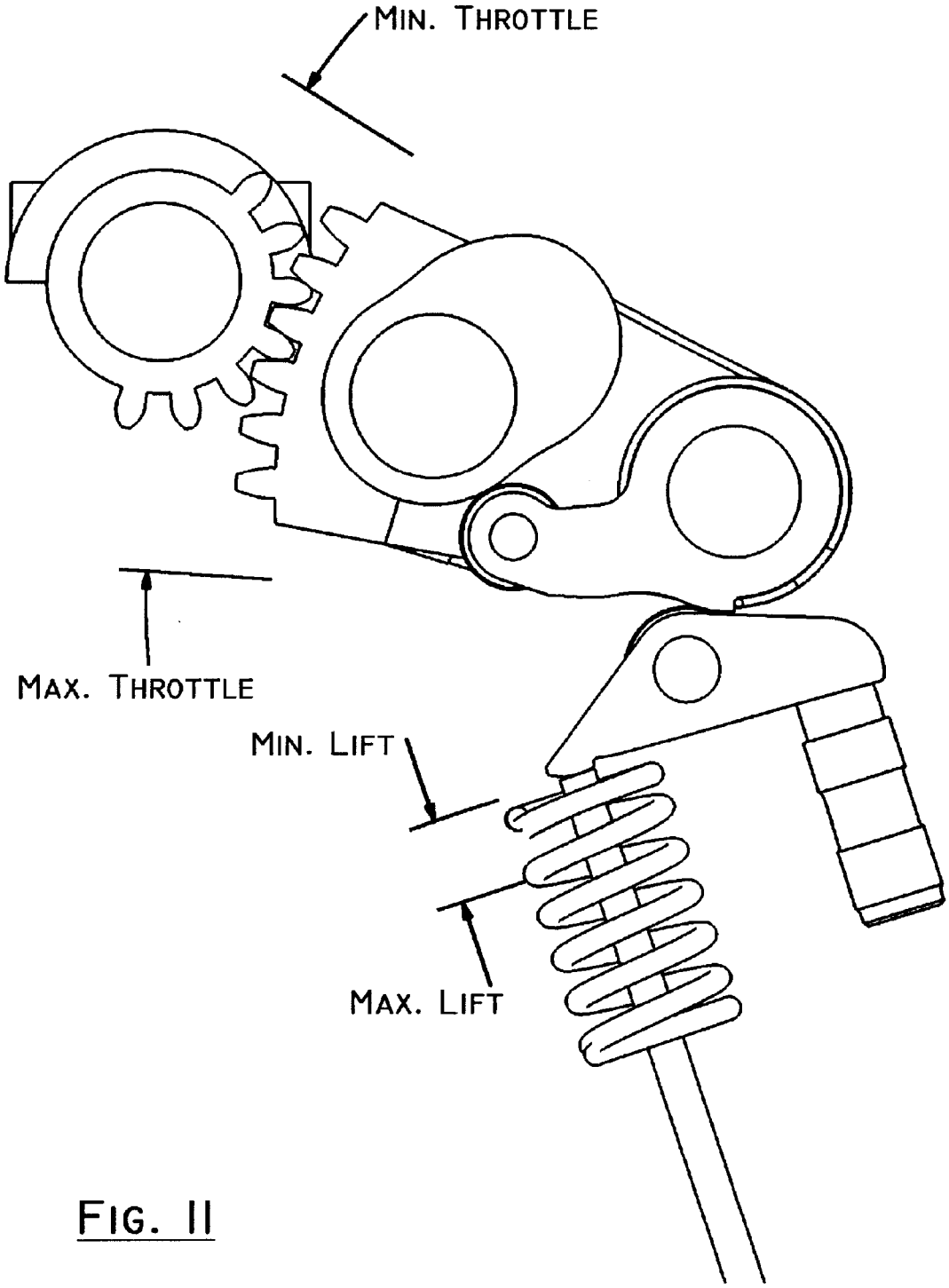
FIG. 11 is a plan view showing the position of the components of the system with the command shaft and the camshaft holder in an intermediate position. The camshaft is in closed position.
Figure 12:
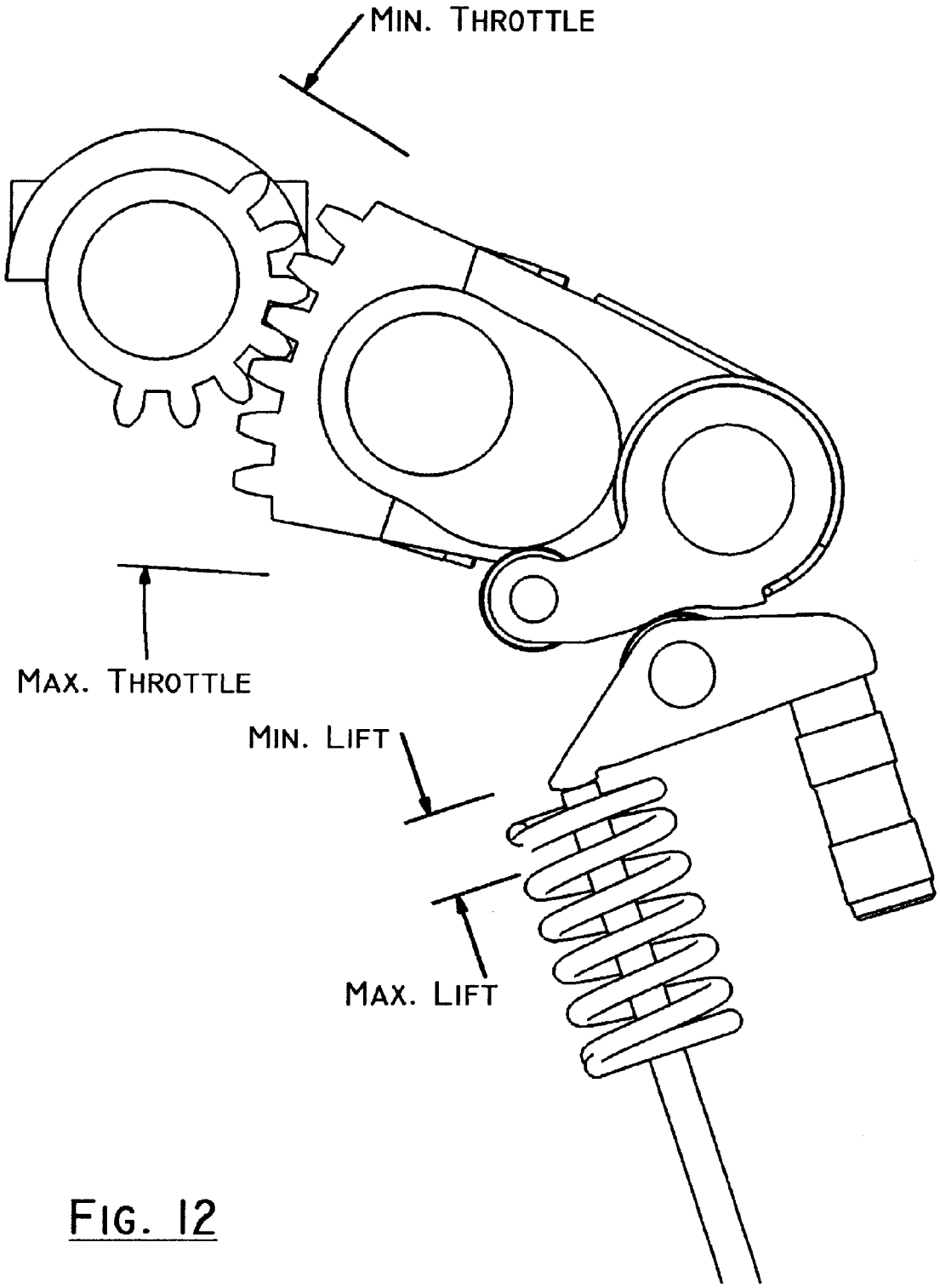
FIG. 12 is a plan view showing the position of the components of the system with the command shaft and the camshaft holder in an intermediate position. The camshaft is in an intermediate position.

As we can see in the FIGS. 11, 12 and 13, compared to FIG. 8, the angular position of the command shaft changes, changing the position of the camshaft holder and, thus, the camshaft is translated towards the roller of the rocker arm. In FIG. 11 the valve remains closed such as in FIGS. 8 and 9. In FIG. 12, the contact between the intermediate arm and roller has just reached the second portion of the working surface and so the roller moved and the valve opened. Since the cam is at an intermediate displacement position, as it continues to rotate, the intermediate arm will continue its movement and, therefore, the valve will continue increasing its lift until it reaches the position shown in FIG. 13. At this point the valve starts closing. As it is seen the valve starts to open earlier, reaches a higher lift and closes later. Compared to FIGS. 8, 9 and 10 it can be seen that the valve has a higher lift and a longer duration.

Figure 16:
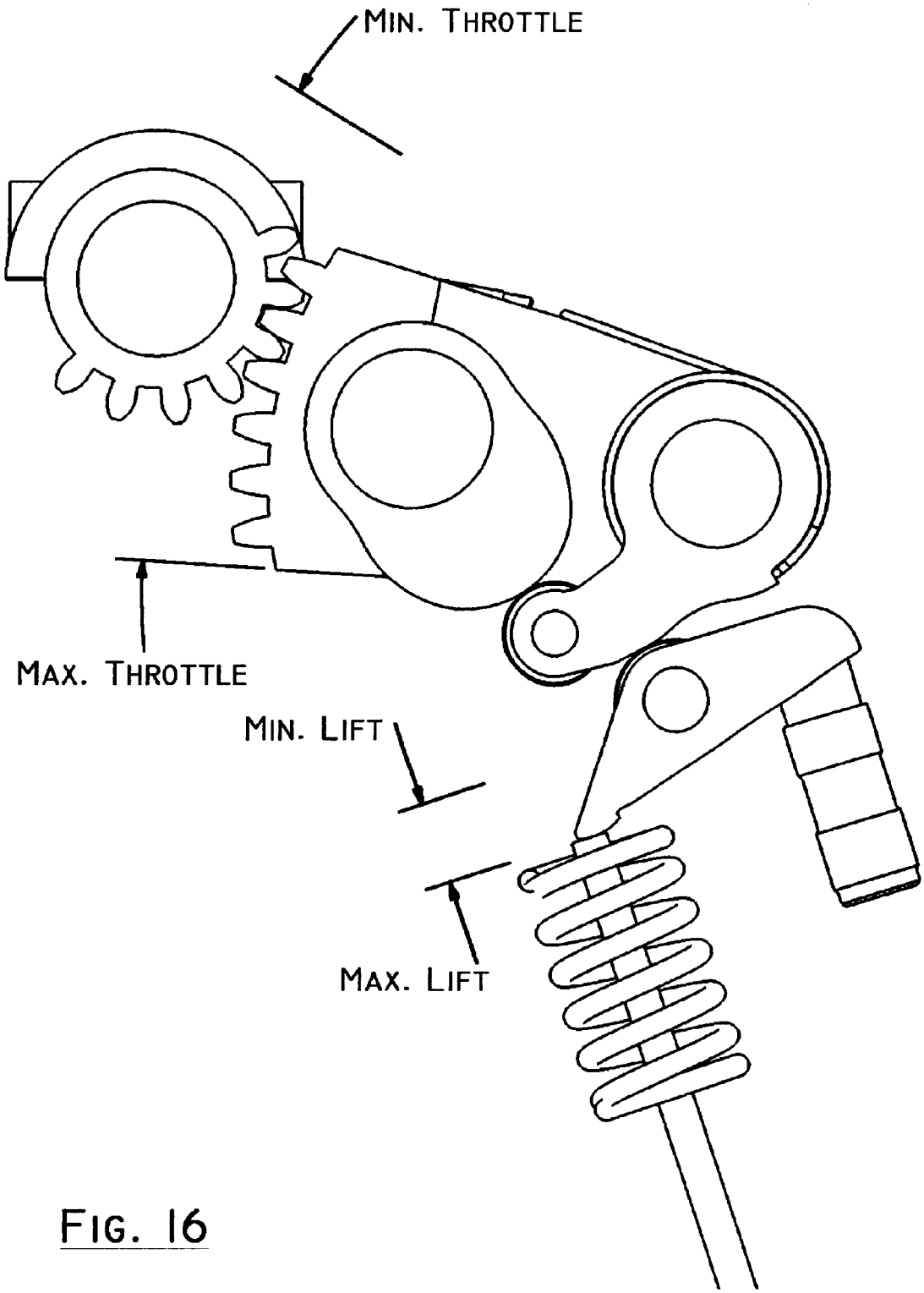
FIG. 16 is a plan view showing the position of the components of the system with the command shaft and the camshaft holder in max throttle position. The camshaft is in open position.

As we can see in the FIGS. 14, 15 and 16 the command shaft is rotated to the max throttle position reaching the camshaft its closest position to the rocker arm. In FIG. 14, the valve is closed but the intermediate arm is almost in the position where it starts to drive the valve. As the cam rotates, the intermediate arm starts to rotate. After a small rotation from the intermediate arm, the valve opens. The cam rotates until the device components reach, first, the position shown in FIG. 15 and, afterwards, the position shown in FIG. 16. This figure shows the device at the valve's maximum lift situation. The valve will remain open almost all the time the intermediate arm is driven by the cam lobe.

Figure 22:
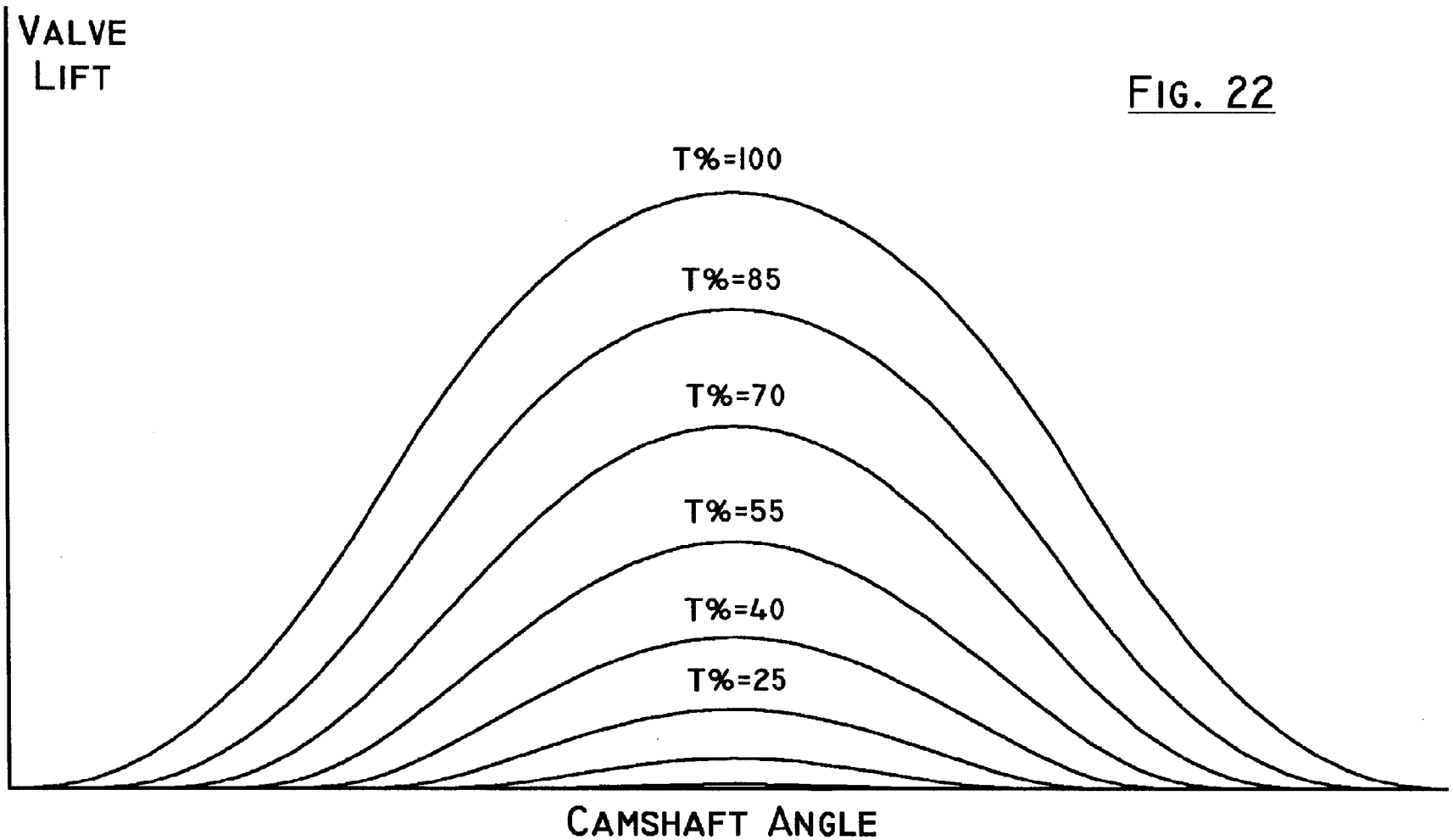
FIG. 22 is a diagram showing lift versus camshaft angle. Each curve corresponds to different command shaft positions. "T%" represents the throttle percentage.

FIG. 22 is a diagram showing valve lift versus camshaft angle. Each curve corresponds to different command shaft positions and thus, different throttle percentages. The greater "T%", greater the throttle. In this diagram it can be appreciated how different command shaft positions provide different combinations of valve lift and duration. The greater the area beneath the curve, greater the air allowed to enter through the valve. Because of this characteristic, the engine could be built without a throttle valve.

Figure 17:
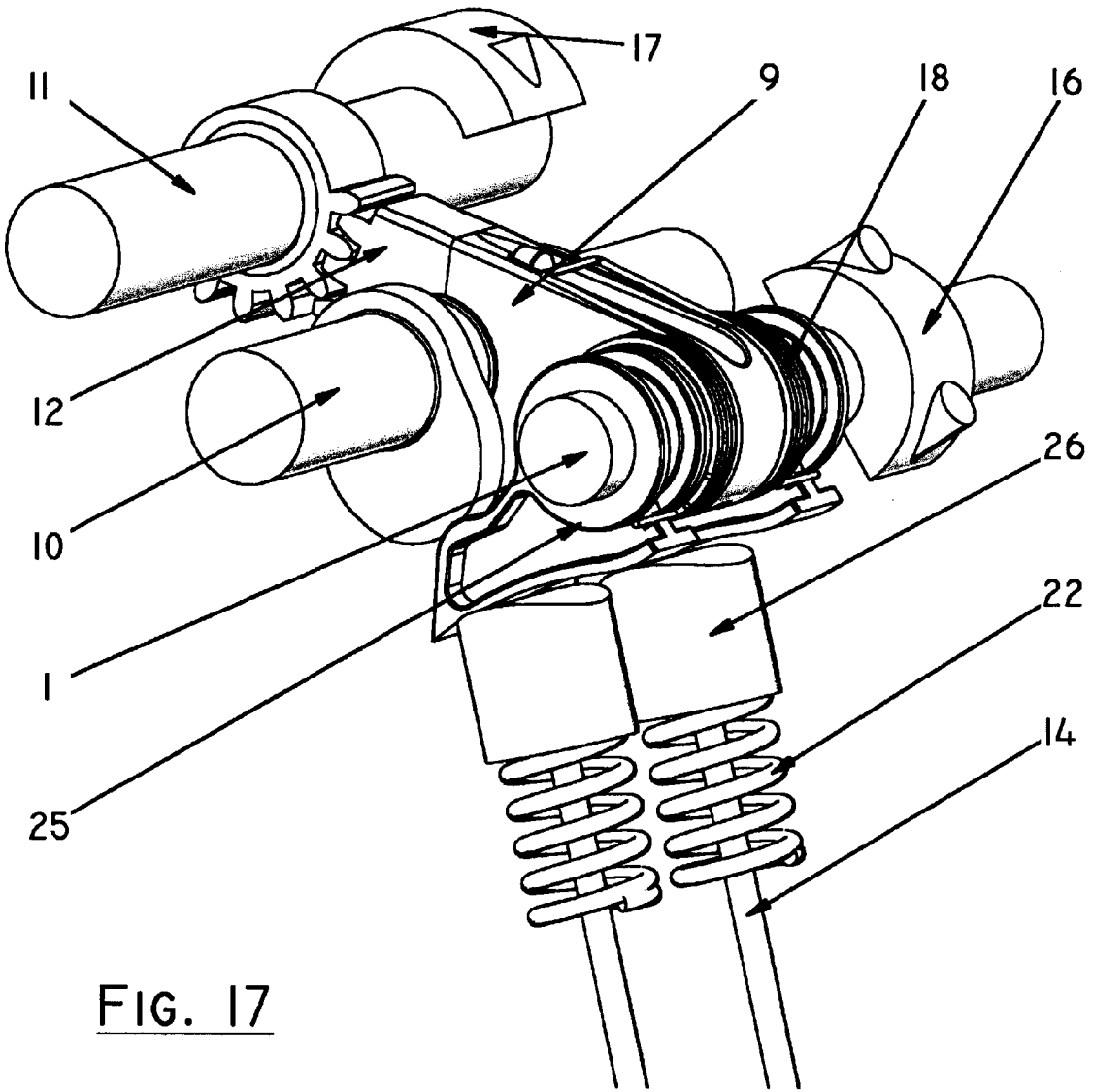
FIG. 17 is a perspective view showing the portion of the cylinder head with all the components of the system, corresponding to a single cylinder, corresponding to an alternative embodiment.
Figure 18:
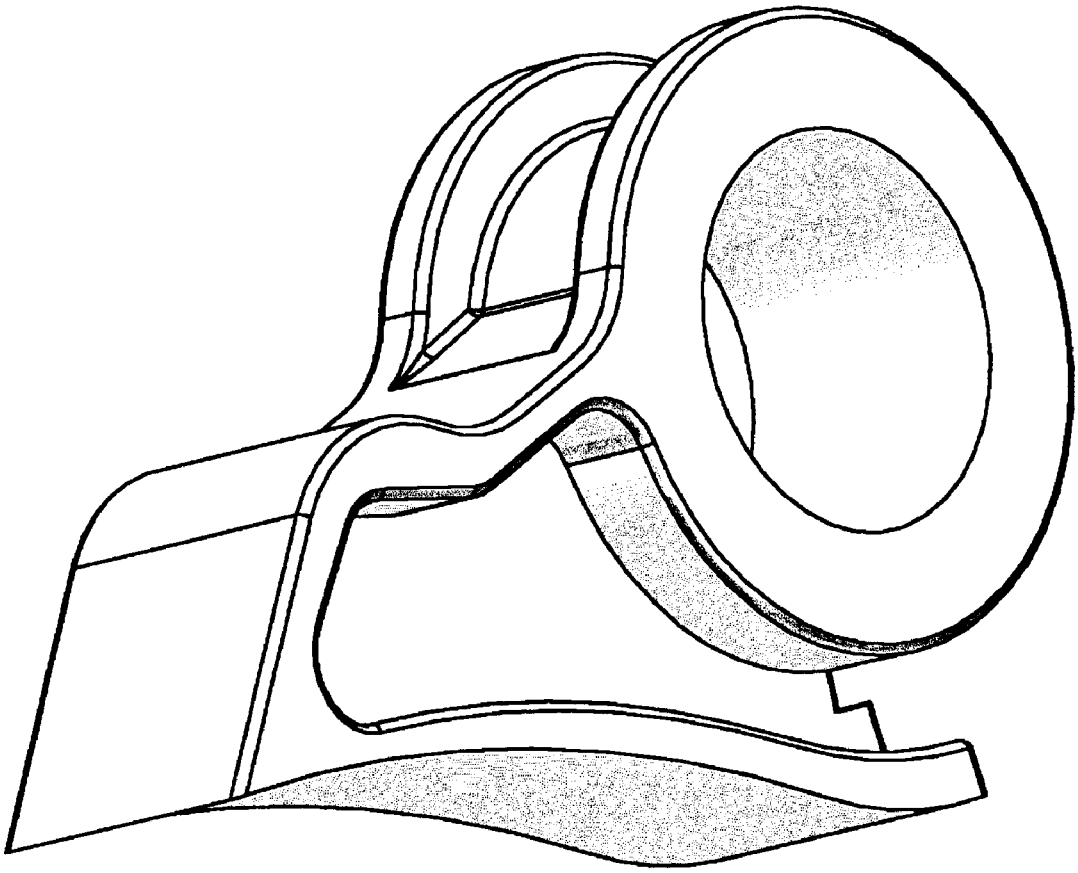
FIG. 18 is a perspective view showing the intermediate arm and its working profile, corresponding to an alternative embodiment.

In FIG. 17 an alternate embodiment is proposed. The object of this proposal is to provide a more economical and simpler alternative. In this proposal the intermediate arms (ref. 2, shown in FIG. 2) are replaced by another ones without roller followers. A better view of this alternate intermediate arm is provided in FIG. 18. Moreover, the lash adjusting device composed by the rocker arm, the roller, the roller pin and the hydraulic adjuster (ref. 5, 7, 6 and 21 respectively, shown in FIG. 6) are replaced by a tappet (ref. 26).

Figure 19:
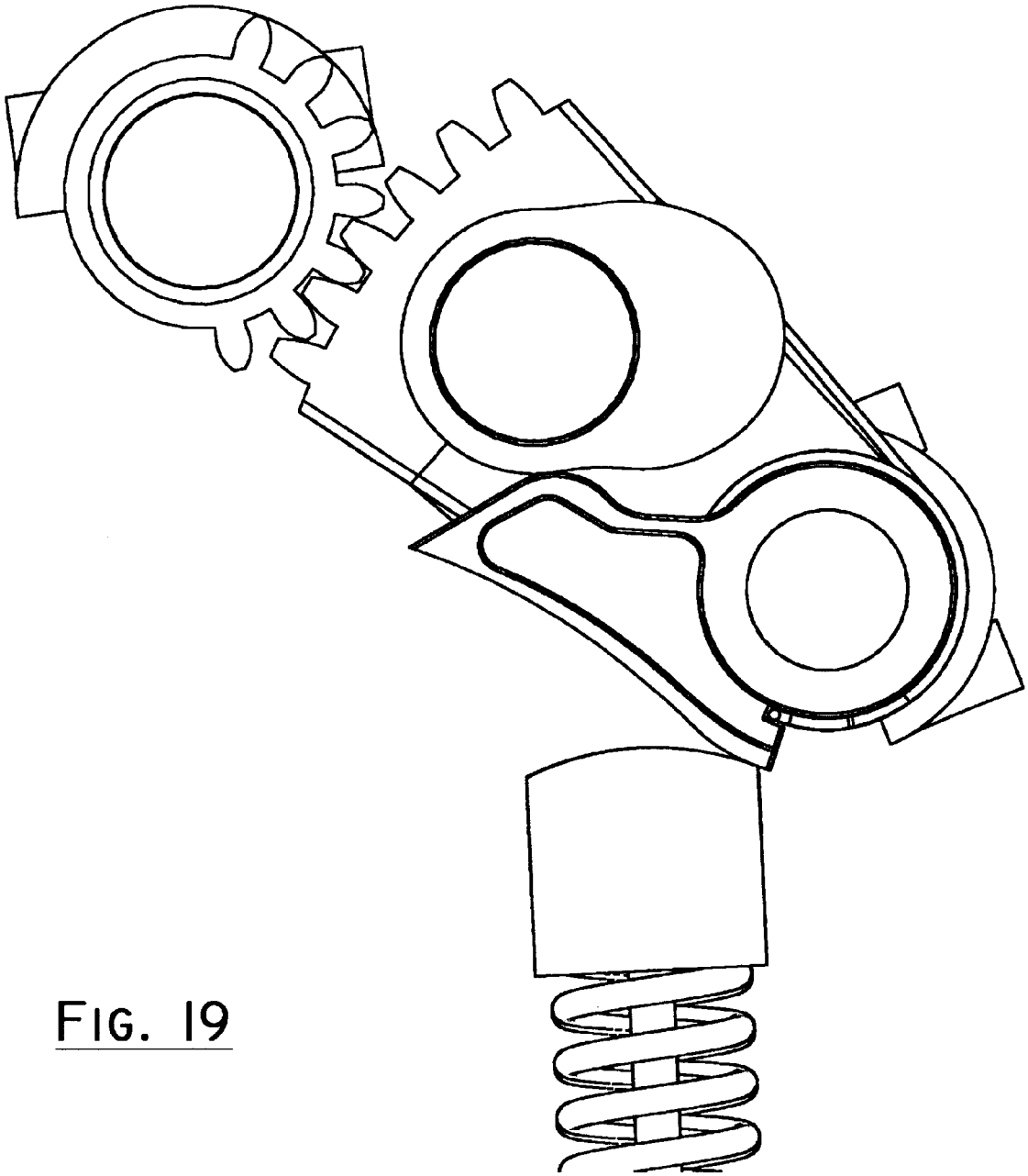
FIG. 19 is a plan view showing the position of the components of the system corresponding to an alternative embodiment, with the command shaft and the camshaft holder in idle position. The camshaft is in closed position.
Figure 20:
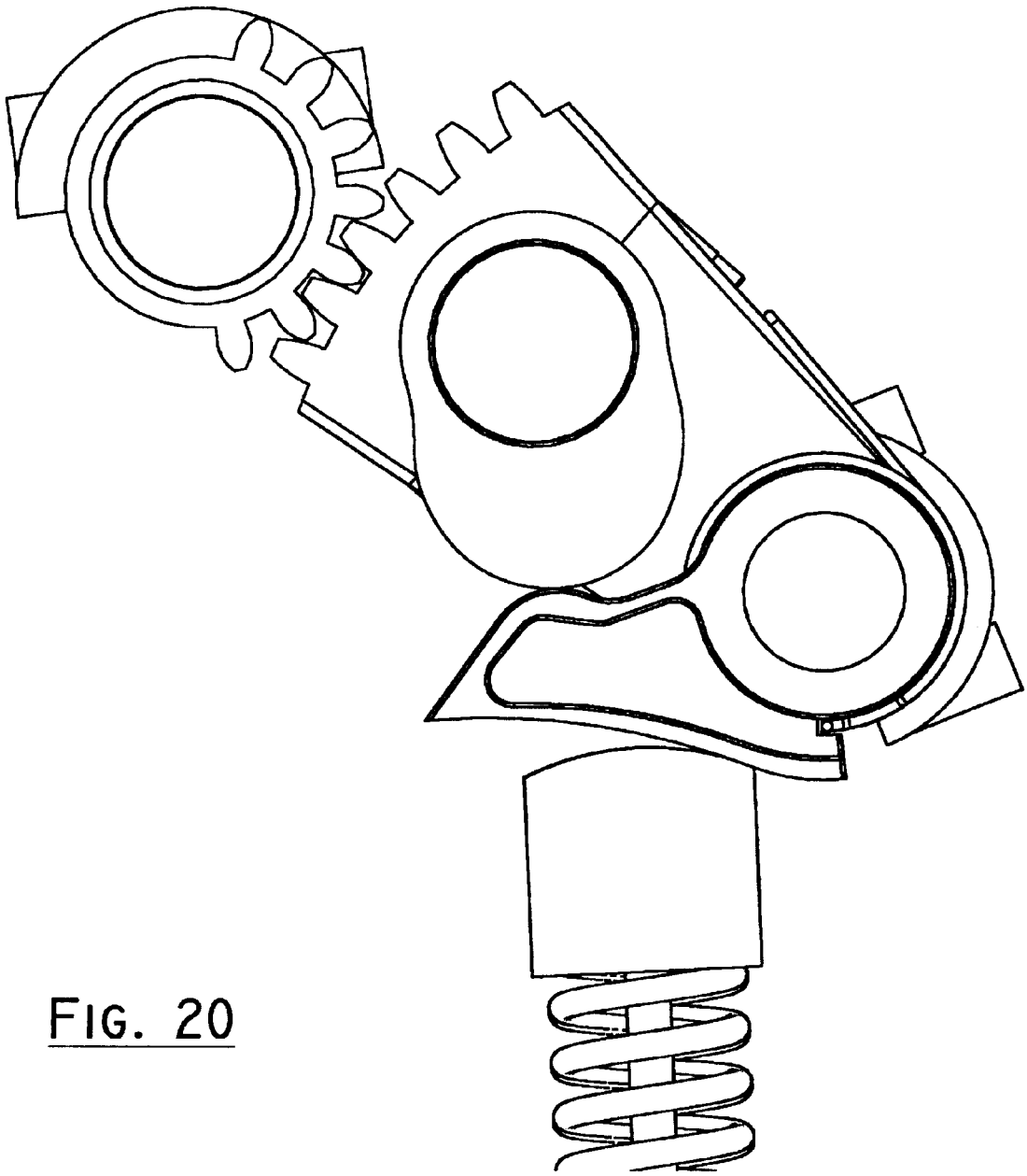
FIG. 20 is a plan view showing the position of the components of the system corresponding to an alternative embodiment, with the command shaft and the camshaft holder in idle position. The camshaft is in open position.
Figure 21:
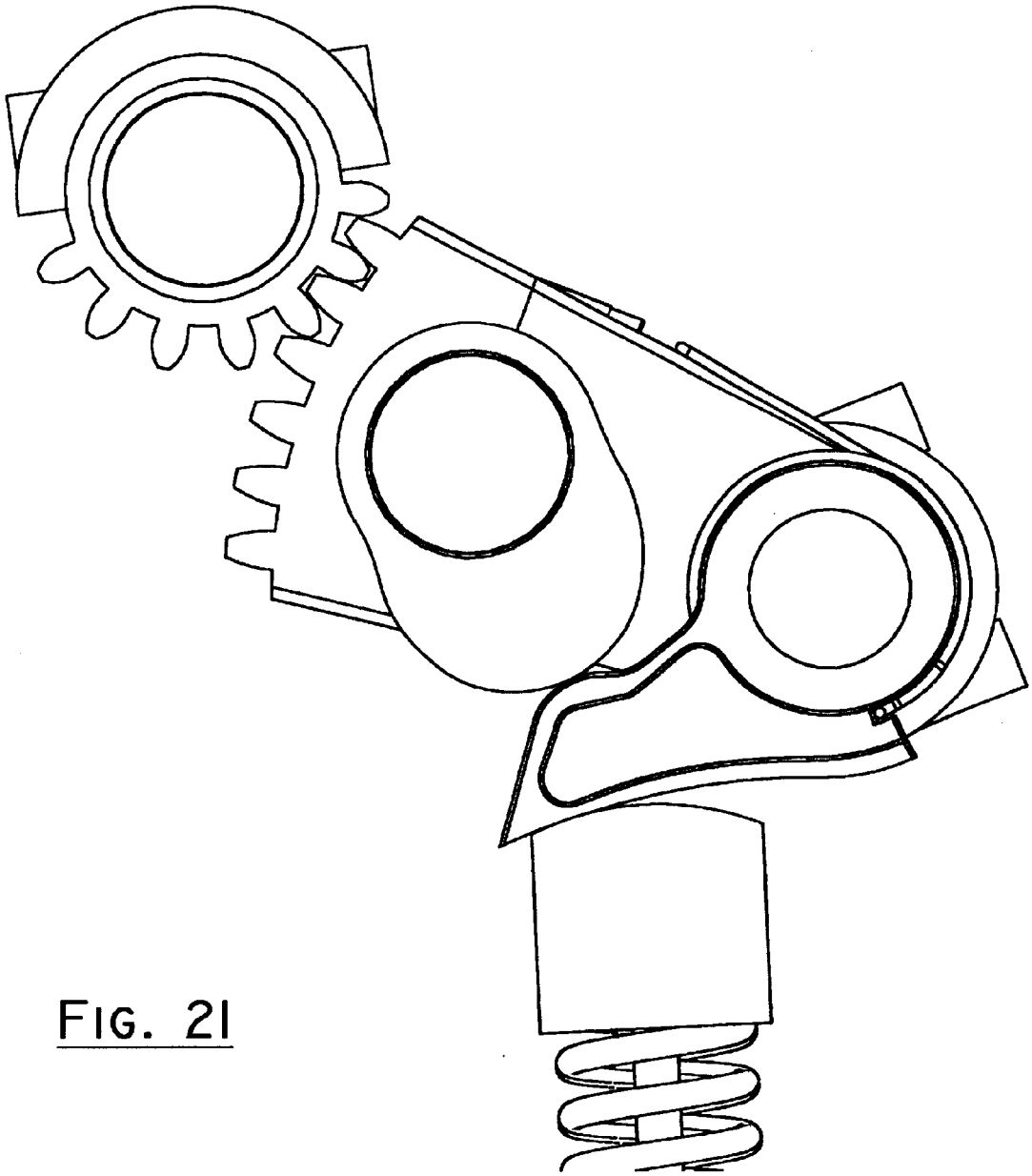
FIG. 21 is a plan view showing the position of the components of the system corresponding to an alternative embodiment, with the command shaft and the camshaft holder in max throttle position. The camshaft is in open position.

FIGS. 19, 20 and 21 describes the same situation described by FIGS. 8, 9 and 16, respectively, but for this alternative embodiment.

Another possibility, to lower costs even more, is the elimination of the phase-difference varying device (ref. 24, shown in FIG. 1). This could be achieved by an accurate study of the transmission ratio between the pair of gears (ref. 23, shown in FIG. 1).

While the invention has been described referred to a preferred embodiment, the invention is not limited to this preferred embodiment or construction, but covers various modifications and arrangements. While the elements of the preferred and alternate embodiments are shown in different configurations, which are exemplary, other combinations are also within the spirit and scope of the invention.

What is claimed is:

1. A valve operating device of an internal combustion engine, capable of varying the lift, the opening and closing angles of the intake valves, composed by:

a main shaft fixed on the cylinder head;

one camshaft holder per cylinder that rotates around the main shaft;

a command shaft mounted on the cylinder head, in a way it can rotate or move;

a camshaft that operates connected to the crankshaft, such that the camshaft is rotated by the crankshaft by means of a pair of gears and a phase-difference varying device;

a rotating cam per admission valve, provided on the camshaft;

an intermediate arm per admission valve, which rotate around the main shaft and transmit a movement to the valves by means of the rolling part of a rocker arm;

a spiral spring per cylinder that forces the intermediate arms to maintain contact with the corresponding cam.

2. A valve operating device as set forth in claim 1, wherein the camshaft holders provide two half bearings inside which the camshaft rotates around it own axis.

3. A valve operating device as set forth in claim 2, wherein the camshaft holders rotate around the main shaft, giving an oscillating motion to the camshaft axis around that main shaft, in a way that the rotational axis of the camshaft moves in a circular path whose center is coincident with the main shaft axis.

4. A valve operating device as set forth in claim 1, wherein the command shaft rotates or moves around a fixed position on the cylinder head, and by this movement, changes simultaneously the angular position of all the camshaft holders.

5. A valve operating device as set forth in claim 1, wherein the intermediate arms rotate around the main shaft, driven by the rotating cams of the camshaft, being kept in contact with the cam by means of the spiral springs.

6. A valve operating device as set forth in claim 5, wherein the intermediate arms has a working surface, which remains in contact with an intermediate component, such a roller or a tappet, that drives the valves.

7. A valve operating device as set forth in claim 6, wherein a portion of the profile of the working surface of the intermediate arms is a segment of circle whose center is coincident with the rotational axis of the main shaft and, as long as the rolling part of the rocker arm remains in contact with that portion, the rocker arm remains in its rest position, and therefore the valve remains closed.

8. A valve operating device as set forth in claim 7, wherein the remaining portion of the working profile of the intermediate arms is a curve that starts from the end point of the previous curve and withdraws from the rotational axis of the main shaft and, as the rolling part of the rocker arm follows this portion of the curve, the rocker arm rotates driving the valve to an open position; the more the rocker arm rotate, the more the valve opens.

9. A valve operating device as set forth in claim 1, wherein for each complete revolution of the camshaft an intermediate arm moves between a minimum angular position and a maximum angular position; during this movement, each one of these extreme positions will determine a corresponding pair of extreme contact points between the working surface of the intermediate arm and the rolling part of the rocker arm; one of these extreme points is located in the first portion of the working surface, and as long as contact remains between this extreme point and the end point of the first portion, the rocker arm will not move; as the contact point moves from this end point to the other extreme point, a proportional movement is transmitted to the rocker arm and, thus, to the valve; the longer this last portion of the movement, bigger the valve lift and longer the time the valve remains open.

10. A valve operating device as set forth in claim 9, wherein the command shaft varies the position of the camshaft, oscillating between a maximum position and a minimum position; each position of the camshaft determines different maximum and minimum positions for the intermediate arms and determines different lifts and opening duration of the valves.

11. A valve operating device as set forth in claim 10, wherein translation of the camshaft varies the degree of lift and the opening duration of the valves.

* * * * *